US009446582B2

(12) United States Patent
Abe et al.

(10) Patent No.: US 9,446,582 B2
(45) Date of Patent: Sep. 20, 2016

(54) PERFECTOR

(71) Applicant: KOMORI CORPORATION, Tokyo (JP)

(72) Inventors: Yoichiro Abe, Tsukuba (JP); Akehiro Kusaka, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/933,407

(22) Filed: Jul. 2, 2013

(65) Prior Publication Data

US 2014/0007785 A1 Jan. 9, 2014

(30) Foreign Application Priority Data

Jul. 3, 2012 (JP) ..... 2012-149076
Jul. 3, 2012 (JP) ..... 2012-149077

(51) Int. Cl.

| | |
|---|---|
| ***B41F 33/00*** | (2006.01) |
| ***B41F 33/14*** | (2006.01) |
| ***B41F 21/08*** | (2006.01) |
| ***B41F 35/00*** | (2006.01) |
| ***B41F 33/12*** | (2006.01) |
| ***B41F 35/06*** | (2006.01) |

(Continued)

(52) U.S. Cl.

CPC ..... *B41F 35/006* (2013.01); *B41F 7/12* (2013.01); *B41F 13/0024* (2013.01);

(Continued)

(58) Field of Classification Search

CPC .. B41F 35/006; B41F 35/06; B41F 13/0024; B41F 21/08; B41F 21/10; B41F 7/12; B41F 33/0018; B41F 33/12; B41F 33/14; B41F 33/0036; B41P 2235/23; B41P 2235/24

USPC ..... 101/425, 229, 231, 232, 183, 246, 142

See application file for complete search history.

(56) References Cited

U.S. PATENT DOCUMENTS 5,142,979 A * 9/1992 Funada et al. ..... 101/183
6,822,590 B2 * 11/2004 Kusaka ..... 341/104

(Continued)

FOREIGN PATENT DOCUMENTS

DE 10 2008 041 847 A1 3/2010
EP 1 136 260 A2 9/2001

(Continued)

OTHER PUBLICATIONS

Extended European Search Report dated Sep. 27, 2013 for European Application No. 13 174 809.7.

*Primary Examiner* — Jill Culler
*Assistant Examiner* — Leo T Hinze
(74) *Attorney, Agent, or Firm* — Birch, Stewart, Kolasch & Birch, LLP

(57) ABSTRACT

A perfector includes: a printing unit that performs printing simultaneously on both surfaces of a paper sheet; detecting means for detecting printing conditions on both surfaces of the paper sheet; and transporting means for transporting the paper sheet to a delivery unit. The printing unit includes: a blanket impression cylinder that holds and transports the paper sheet; and a blanket cylinder in contact with the blanket impression cylinder. The transporting means includes: a transfer cylinder in contact with the blanket impression cylinder and receives the paper sheet from the blanket impression cylinder; and a delivery cylinder in contact with the transfer cylinder and receives the paper sheet from the transfer cylinder. The detecting means includes: a first checking camera that detects the printing condition on one surface of the paper sheet; and a second checking camera that detects the printing condition on the other surface of the paper sheet.

6 Claims, 4 Drawing Sheets

(51) Int. Cl.
*B41F 7/12* (2006.01)
*B41F 13/00* (2006.01)

(52) U.S. Cl.
CPC ..... *B41F 33/0018* (2013.01); *B41F 33/0036* (2013.01); *B41F 33/12* (2013.01); *B41F 35/06* (2013.01); *B41P 2235/23* (2013.01); *B41P 2235/24* (2013.01)

(56) References Cited

U.S. PATENT DOCUMENTS

| | | | | |
|---|---|---|---|---|
| 6,883,429 | B2 * | 4/2005 | Kamoda | 101/480 |
| 8,065,957 | B2 * | 11/2011 | Schaede et al. | 101/232 |
| 8,528,477 | B2 * | 9/2013 | Schaede et al. | 101/480 |
| 2001/0027730 | A1 | 10/2001 | Kamoda | |
| 2009/0025594 | A1 | 1/2009 | Schaede et al. | |
| 2011/0197776 | A1 | 8/2011 | Ruhmke et al. | |
| 2013/0213246 | A1 * | 8/2013 | Schaede et al. | 101/76 |

FOREIGN PATENT DOCUMENTS

| | | | |
|---|---|---|---|
| EP | 1 834 779 | A1 | 9/2007 |
| JP | 2001-287344 | A | 10/2001 |
| JP | 2009-530130 | A | 8/2009 |
| JP | 2009-530131 | A | 8/2009 |
| WO | WO 2007/105059 | A1 | 9/2007 |
| WO | WO 2007/105061 | A1 | 9/2007 |
| WO | WO 2011145028 | A1 * | 11/2011 |

* cited by examiner

PERFECTOR

TECHNICAL FIELD

The present invention relates to a perfector configured to perform printing simultaneously on both surfaces of a sheet and more specifically to a perfector capable of quickly performing a check while avoiding an increase in the size of a perfector.

BACKGROUND ART

Conventionally, there has been a perfector disclosed in Patent Literature 1.

The perfector disclosed in Patent Literature 1 includes: a blanket impression cylinder and a blanket cylinder being in contact with each other and configured to perform printing on both surfaces of a paper sheet; inking units configured to supply inks to the blanket impression cylinder and the blanket cylinder and supported to be movable toward and away from the blanket impression cylinder and the blanket cylinder; and transporting means for holding and transporting the printed paper sheet to a delivery unit. In the perfector, the transporting means is formed of: a first delivery chain extending below the inking units; first to third transfer cylinders configured to transport the paper sheet from the first delivery chain; and a second delivery chain configured to transport the paper sheet from the first to third transfer cylinders. Moreover, the perfector includes: a checking camera configured to detect a printing condition on one surface of the paper sheet transported by the first transfer cylinder; and another checking camera configured to detect a printing condition on the other surface of the paper sheet transported by the second transfer cylinder.

In this perfector, it is regarded that, since a quality check of both surfaces is performed in-line in a period between the printing on both surfaces and the delivery, there are no increase in installation space and no increase in the overall length of the perfector.

CITATION LIST

Patent Literatures

{Patent Literature 1} Japanese Patent Application Publication No. 2001-287344

{Patent Literature 2} Published Japanese Translation of PCT International Application No. 2009-530131

SUMMARY OF INVENTION

Technical Problem

However, in the perfector disclosed in Patent Literature 1, since the printing quality of the paper sheet is checked on the first and second transfer cylinders by the checking cameras after the paper sheet has passed the first delivery chain, the transport distance of the paper sheet from the both-surface printing position to the checking position is inevitably long. Accordingly, the perfector has a problem that detection of a defective paper sheet is delayed and the number of waste paper sheets accumulated on the first delivery chain increases due to the delay. Moreover, since the dedicated first to third transfer cylinders are required between the first delivery chain and the second delivery chain as part of the detection device, the perfector has a problem that the increased number of parts causes increases in the size of the perfector and the cost.

Moreover, since the dedicated first to third transfer cylinders are required between the first delivery chain and the second delivery chain as part of the detection device, the perfector has a problem that the increased number of parts causes increases in the size of the perfector and the cost.

In view of this, Patent Literature 2 discloses an example of a perfector having a short distance from the both-surface printing position to the checking position.

Patent Literature 2 gives a description of a sheet checking system for a sheet-fed perfector of a type including two printing cylinders for carrying out simultaneous printing on both surfaces of a sheet. The sheet checking system includes at least a first checking device for capturing an image of a first side of the printed sheet. The first checking device includes a first line image sensor for performing line-scan image acquisition of the first side of the printed sheet, and the first checking device is disposed in such a way that the first line image sensor visually acquires an image of the printed sheet while the printed sheet is still adhering onto the surface of a first printing cylinder of the two printing cylinders of the perfector and immediately before the printed sheet is transferred to a chain gripper system of the perfector.

In addition to the first checking device, the perfector is provided with a second checking device including a second line image sensor for acquiring a line-scan image of a second side of the printed sheets, the second line image sensor disposed to face the first transfer cylinder.

In the invention of Patent Literature 2, since the check is performed at a position immediately after the printing while the printed sheet is still adhered onto one of the printing cylinders, it is possible to make the perfector more compact without drastically modifying an existing perfector, effectively prevent smearing on the sheet during the check to avoid an increase of waste sheets, and check both surfaces of the sheet.

However, in the perfector disclosed in Patent Literature 2, a space around a circumferential surface of the first printing cylinder where the check by the first line image sensor is performed is extremely small due to the second printing cylinder and the first transfer cylinder which are in contact with the first printing cylinder, and there is a need to use a mirror to acquire the line-scan image. In the configuration of Patent Literature 2 in which the line-scan image is acquired by using the mirror, the mirror requires frequent washing and works of attaching and removing the mirror and a work of adjusting an installation angle have to be performed every time the washing is performed. These works in a small region are a great burden to an operator.

In this respect, an object of the present invention is to improve a conventional perfector and provide a perfector which can quickly perform a check while avoiding an increase in the size of the perfector and which can reduce a burden on an operator by improving the workability.

Solution to Problem

To achieve the object described above, the present invention provides a perfector including: a printing unit configured to perform printing simultaneously on both surfaces of a sheet; detecting means for detecting printing conditions on both surfaces of the sheet on which the printing is performed simultaneously; and transporting means for holding and transporting the detected sheet to a discharging unit, characterized in that the printing unit includes: a first printing cylinder configured to hold and transport the sheet; and a second printing cylinder disposed lateral to the first printing cylinder and being in contact with the first printing cylinder, the transporting means includes: a transfer cylinder being in contact with the first printing cylinder and configured to receive, from the first printing cylinder, the sheet on which printing is performed on both surfaces by the first printing cylinder and the second printing cylinder; and a delivery cylinder being in contact with the transfer cylinder and configured to receive the sheet from the transfer cylinder, and the detecting means includes: a first checking camera configured to detect the printing condition on one surface of the sheet transported by the transfer cylinder; and a second checking camera configured to detect the printing condition on the other surface of the sheet transported by the delivery cylinder.

Moreover, the perfector is characterized in that the first checking camera is disposed on the discharging unit side of the transfer cylinder.

Furthermore, the perfector is characterized in that the first checking camera is disposed to be capable of checking the sheet at a position away from a contact position between the first printing cylinder and the transfer cylinder by a distance equal to or more than a length of a maximum-size sheet from a leading end to a trailing end thereof.

Moreover, the perfector is characterized in that the first printing cylinder is disposed on the discharging unit side of the second printing cylinder, and the perfector further comprises:

a workspace formed below the second printing cylinder; and an opening configured to allow an operator to enter and exit the workspace.

Furthermore, the perfector is characterized in that the second checking camera is disposed below the second printing cylinder.

Moreover, the perfector is characterized in that the perfector comprises:

a first washing device configured to wash a circumferential surface of the first printing cylinder; and a second washing device configured to wash a circumferential surface of the second printing cylinder, the first washing device is disposed to wash the circumferential surface of the first printing cylinder at a position downstream of a contact position between the first printing cylinder and the second printing cylinder in the rotating direction of the first printing cylinder and upstream of the contact position between the first printing cylinder and the transfer cylinder in the rotating direction of the first printing cylinder, and the second washing device is disposed to wash the circumferential surface of the second printing cylinder at a position below the second printing cylinder.

Furthermore, the perfector is characterized in that the perfector further comprises:

a detecting device configured to detect a state where an entry into the workspace is possible or detect an entry of an operator; and a controlling device configured to control a drive device of the perfector on the basis of a detection signal from the detecting device.

Advantageous Effects of Invention

Since the perfector of the present invention can check both surfaces of the sheet immediately after the printing on both surfaces, it is possible to stop the perfector immediately after generation of a defective paper sheet and thereby avoid an increase of waste paper sheets which would otherwise occur if the operation of the perfector is wastefully continued. Moreover, since the check can be performed by, for example, utilizing the existing cylinder arrangement, not only an increase in the size of the perfector can be avoided but also the cost can be reduced due to reduction in the number of parts. Moreover, the workability can be improved to reduce the burden on the operator.

DESCRIPTION OF EMBODIMENT

A checking device of a perfector in the present invention is described below in detail by using an embodiment and the drawings.

Embodiment

Figure 1:
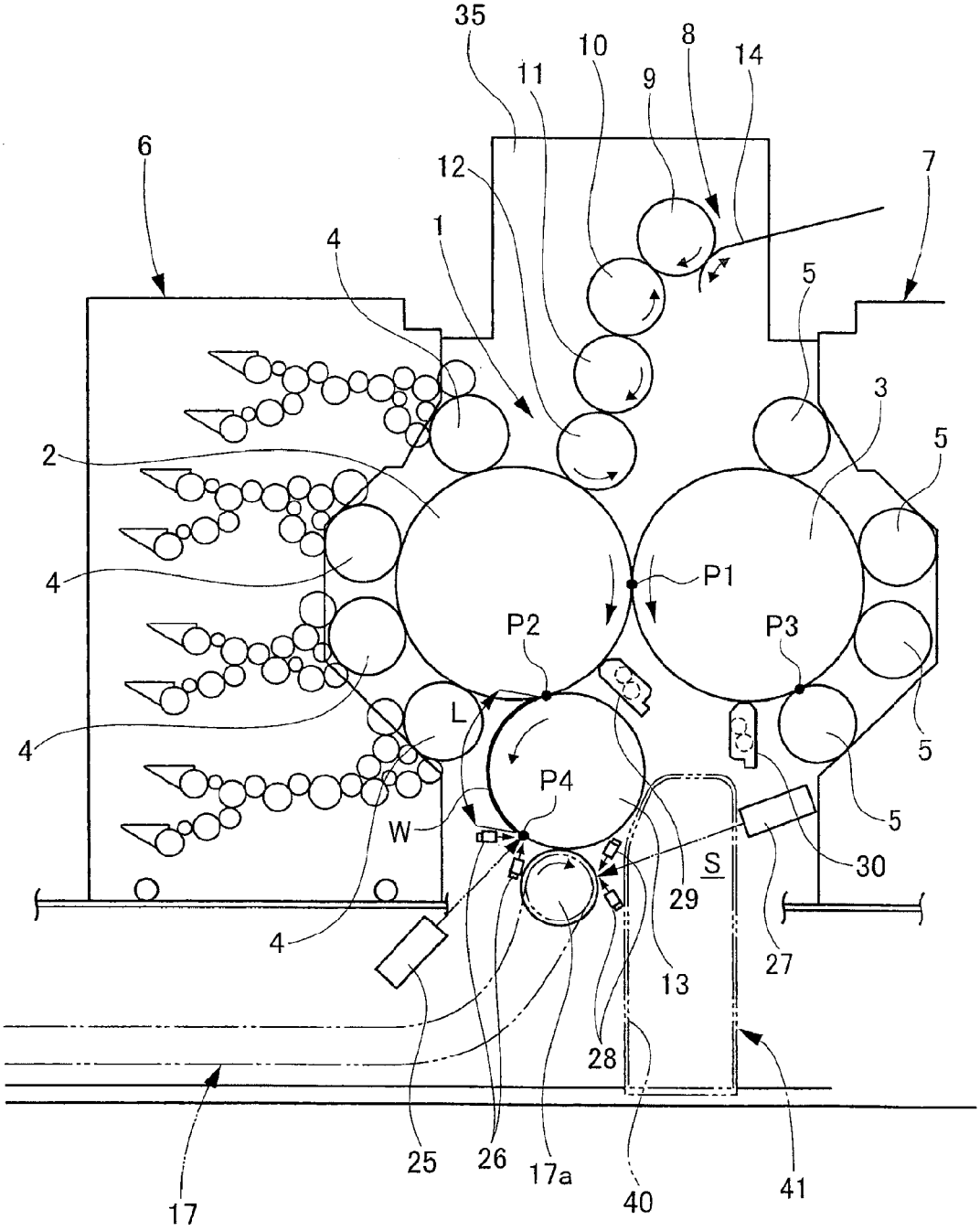
FIG. 1 is an enlarged side view of a main portion of a four-color offset perfector (perfector) which shows one embodiment of the present invention
Figure 2:
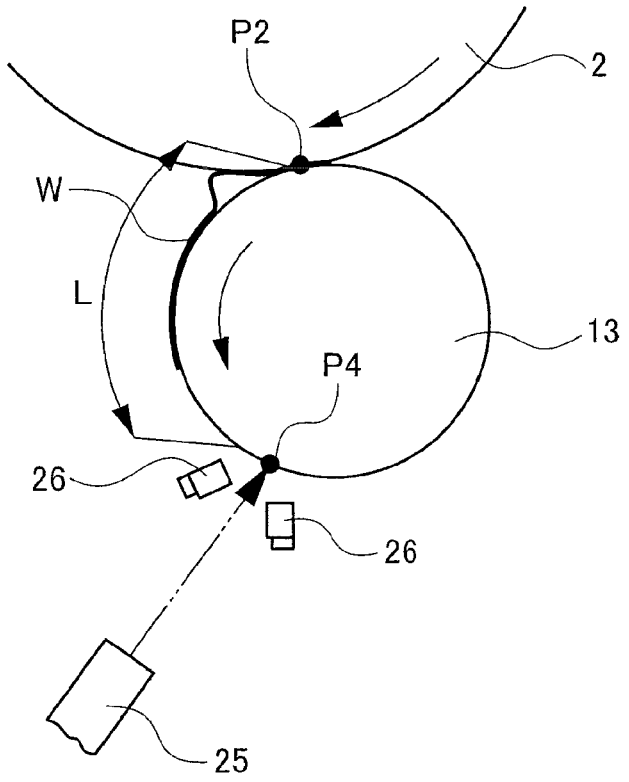
FIG. 2 is an explanatory diagram shown an example of a failure during an operation in the present invention
Figure 3:
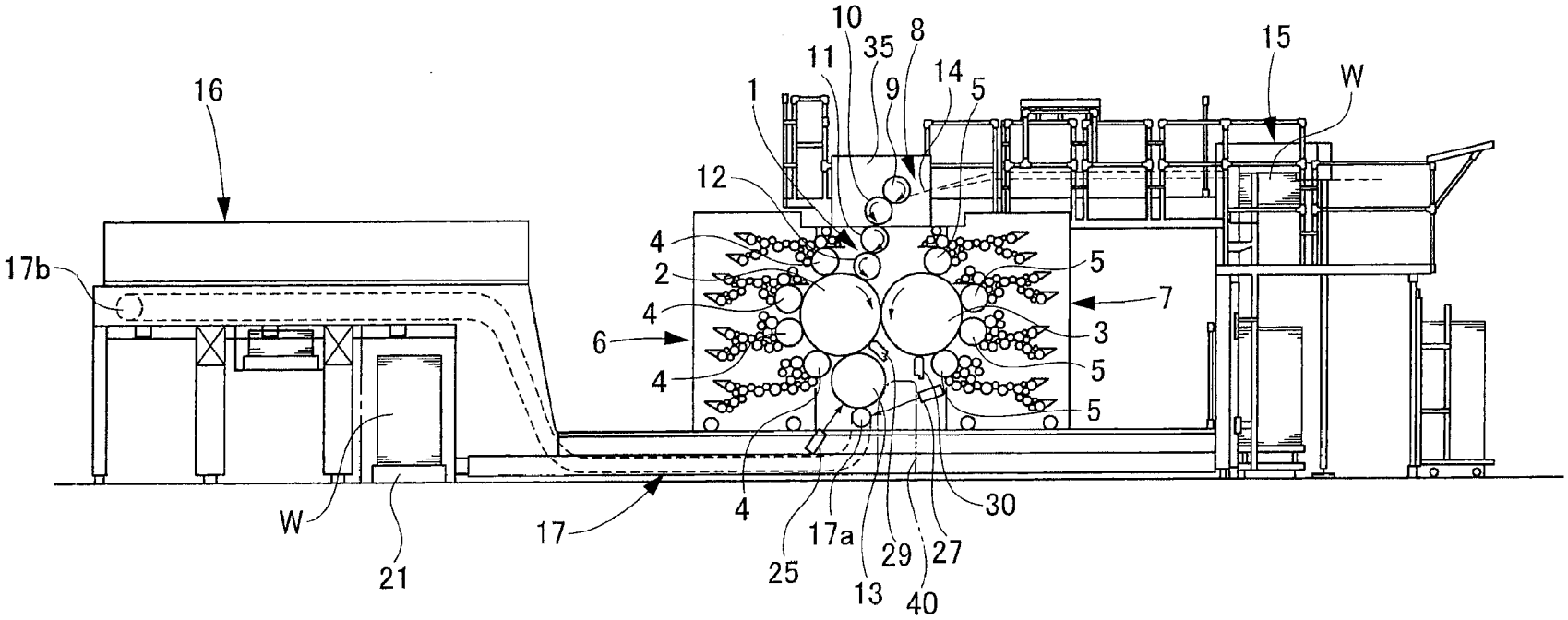
FIG. 3 is an overall side view of the four-color offset perfector.
Figure 4:
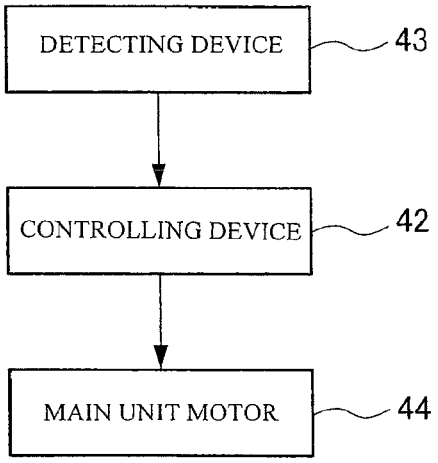
FIG. 4 is a control block diagram of the four-color offset perfector.

FIG. 1 is an enlarged side view of a main portion of a four-color offset perfector which shows one embodiment of the present invention, FIG. 2 is an explanatory diagram showing an example of a failure during an operation in the present invention, FIG. 3 is an overall side view of the four-color offset perfector, and FIG. 4 is a control block diagram of the four-color offset perfector.

As shown in FIGS. 1 and 3, in a printing unit 1 of the four-color offset perfector (perfector), a blanket impression cylinder (first printing cylinder) 2 including a paper-sheet gripping (holding) device (not illustrated) and a blanket cylinder (second printing cylinder) 3 including no paper-sheet gripping (holding) device are substantially-horizontally supported, and circumferential surfaces of the respective cylinders come in contact with each other. Moreover, the blanket cylinder 3 is in contact with the blanket impression cylinder 2 while being disposed lateral to the blanket impression cylinder 2, and the blanket impression cylinder 2 and the blanket cylinder 3 are arranged respectively on a delivery unit (discharging unit) 16 side and a feeding unit 15 side.

Furthermore, four plate cylinders 4 are disposed on the circumferential surface of the blanket impression cylinder 2 while four plate cylinders 5 are disposed on the circumferential surface of the blanket cylinder 3. Inking units 6 and 7 are provided to be movable toward and away from the plate cylinders 4 and 5, and can supply inks and water in a state in contact with the plate cylinders 4 and 5. The blanket impression cylinder 2, the plate cylinders 4, the blanket cylinder 3, and the plate cylinders 5 form the printing unit configured to perform printing simultaneously on both surfaces of a paper sheet (sheet) W.

Moreover, four transfer cylinders 9 to 12 including paper-sheet gripping (holding) devices and configured to receive the paper sheet W from a register 8 and transfer the paper sheet W to the blanket impression cylinder 2 are disposed above the blanket impression cylinder 2, that is upstream of a printing position P1 in a rotating direction of the blanket impression cylinder 2, the printing position P1 being a contact position between the blanket impression cylinder 2 and the blanket cylinder 3. In addition, a transfer cylinder 13 including a paper-sheet gripping (holding) device and configured to receive the paper sheet W from the blanket impression cylinder 2 and transfer the paper sheet W to a delivery chain 17 to be described later is provided below the blanket impression cylinder 2, that is downstream of the printing position P1 in the rotating direction of the blanket impression cylinder 2.

The paper sheet W is supplied from the feeding unit (supplying unit) 15 to the register 8 via a feeder board 14. Meanwhile, the paper sheet W is transported from the transfer cylinder 13 onto a delivery pile 21 of the delivery unit 16 via the delivery chain 17 including gripper bars (chain grippers) which are not illustrated. Specifically, a delivery cylinder 17*a* on an upstream side of the delivery chain 17 in a paper-sheet transporting direction is in contact with a lower side of the transfer cylinder 13, and the paper sheet W is received from the transfer cylinder 13. The transfer cylinder 13 and the delivery chain 17 (including the delivery cylinders 17*a* and 17*b*) form transporting means configured to hold and transport the paper sheet (sheet) W to the delivery unit 16.

Moreover, the delivery chain 17 is arranged in the following way. The delivery cylinder 17*a* on the upstream side thereof is arranged below the blanket impression cylinder 2 and the delivery chain 17 extends along a floor to the delivery unit 16 side of the delivery cylinder 17*a*, on the left side of the drawing, without traversing a space below the contact position between the blanket impression cylinder 2 and the blanket cylinder 3.

In the illustrated example, the blanket impression cylinder 2 and the blanket cylinder 3 are triple-size cylinders, the four transfer cylinders 9 to 12, the four plate cylinders 4, the four plate cylinders 5, and the delivery cylinder 17*a* are single-size cylinders, and the transfer cylinder 13 is a double-size cylinder.

Furthermore, a first checking camera 25 which is detecting means for detecting a printing condition on one surface (front surface) of the paper sheet W transported by the transfer cylinder 13 is located on the delivery unit 16 side of the transfer cylinder 13 together with a pair of illuminators 26 and is disposed in an oblique upward direction to be directed at the transfer cylinder 13. Meanwhile, a second checking camera (checking device) 27 which is detecting means for detecting a printing condition on the other surface (back surface) of the paper sheet W transported by the delivery cylinder 17*a* is located on the feeding unit 15 side of the delivery cylinder 17*a* (below the blanket cylinder 3) together with a pair of illuminators 28 and is disposed in an oblique downward direction to be directed at the delivery cylinder 17*a*.

The first checking camera 25 (including the pair of illuminators 26) is arranged to be capable of checking the printing condition of the paper sheet W at a position on the circumferential surface of the transfer cylinder 13 which is a double-size cylinder, the position being away from a contact position (see a sheet receiving position P2) between the blanket impression cylinder 2 and the transfer cylinder 13 by a distance equal to or more than a length L of a maximum-size paper sheet on which the perfector can perform printing, from a leading end to a trailing end thereof. Specifically, the distance (circumferential length) from the contact position (see the sheet receiving position P2) between the blanket impression cylinder 2 and the transfer cylinder 13 to the checking position (see a first checking position P4) of the first checking camera in the transfer cylinder 13 is equal to or more than the length L of the maximum-size paper sheet on which the perfector can perform printing, from a leading end to a trailing end thereof (equal to or longer than L). Note that optical-electrical imaging devices such as CCD line cameras and CCD line sensors are used as the first and second checking cameras 25 and 27.

Moreover, there is disposed a first blanket washing device (first washing device) 29 configured to wash the circumferential surface of the blanket impression cylinder 2 by facing a portion of the blanket impression cylinder 2 which is downstream of the contact position (see the printing position P1) between the blanket impression cylinder 2 and the blanket cylinder 3 in the rotating direction of the blanket impression cylinder 2 and which is upstream of the contact position (see the sheet receiving position P2) between the blanket impression cylinder 2 and the transfer cylinder 13 in the rotating direction of the blanket impression cylinder 2. In addition, there is disposed a second blanket washing device (second washing device) 30 configured to wash the circumferential surface of the blanket cylinder 3 being in contact with the blanket impression cylinder 2, by facing a portion of the blanket cylinder 3 which is downstream of the contact position (see the printing position P1) between the blanket impression cylinder 2 and the blanket cylinder 3 in the rotating direction of the blanket cylinder 3 and which is upstream of a contact position (see an ink supplying position P3) between the blanket cylinder 3 and the plate cylinder 5 at the lowest position in the rotating direction of the blanket cylinder 3. The first and second blanket washing devices 29 and 30 are devices configured to remove inks by causing a brush or a cloth to come in contact with blankets of the blanket impression cylinder 2 and the blanket cylinder 3 after the printing is completed.

An opening 40 which is closed and opened by a door 41 is provided at a position in a main unit frame 35 which corresponds to the printing unit 1, and an operator can enter and exit a workspace S formed below the blanket cylinder 3, through the opening 40.

Moreover, as shown in FIG. 2, there is provided a detecting device 43 configured to detect a state where an entry into the workspace S is possible or to detect an entry of the operator, and there is also provided a controlling device 42 configured to control a main unit motor (drive device of the perfector) 44 on the basis of detection signals from the detecting device 43.

Specifically, a switch (switch configured to detect the state where an entry into the workspace S is possible) configured to detect opening and closing of the door 41 or a photoelectric sensor (sensor configured to detect an entry of the operator) is selected as appropriate and used as the detecting device 43.

When the switch detects that the door 41 is opened while the perfector is operating or when the photoelectric sensor detects that the door 41 is opened and the operator has entered the workspace S from the opening 40, the controlling device 42 to which the detection signals are inputted controls the drive of the main unit motor 44 in such a way as to stop the main unit motor 44. Moreover, the controlling device 42 controls the drive of the main unit motor 44 in such a way that the main unit motor 44 is not driven with the door 41 opened.

Since the perfector is configured as described above, each of paper sheets W supplied from the feeding unit 15 and positioned by the register 8 is transported along a path shown by the arrows in the drawings, i.e. along the respective circumferential surfaces of the transfer cylinders 9 to 12, the blanket impression cylinder 2, the transfer cylinder 13, and the delivery cylinder 17*a* in this order, and is subjected to printing simultaneously on both surfaces upon passing through the contact position (see the printing position P1) between the blanket impression cylinder 2 and the blanket cylinder 3 from above to below.

The paper sheets W having been subjected to printing are transported one by one to the delivery cylinder 17*b* in FIG. 3 by the delivery chain 17, and are piled on a predetermined delivery pile 21 in the delivery unit 16.

Moreover, in the embodiment, when each paper sheet W is transported by the transfer cylinder 13, the printing condition on the front surface thereof is detected by the first checking camera 25. Meanwhile, when the paper sheet W is transported by the delivery cylinder 17*a*, the printing condition on the back surface thereof is detected by the second checking camera 27.

In this case, in the transfer cylinder 13, the first checking camera 25 (including the pair of illuminators 26) checks the printing condition of the paper sheet W at the position on the circumferential surface of the transfer cylinder 13 which is a double-size cylinder, the position being away from the contact position (see the sheet receiving position P2) between the blanket impression cylinder 2 and the transfer cylinder 13 by a distance equal to or slightly exceeding the length L of the maximum-size paper sheet on which the perfector can perform printing, from a leading end to a trailing end thereof.

As a result, the check is performed in a stable transporting state of the paper sheet W in which the trailing edge of the paper sheet W has completely passed the contact position (see the sheet receiving position P2) between the blanket impression cylinder 2 and the transfer cylinder 13. Accordingly, a highly-accurate check can be performed.

Specifically, as shown in FIG. 2, in a case where the trailing edge of the paper sheet W has not yet passed the contact position (see the sheet receiving position P2) between the blanket impression cylinder 2 and the transfer cylinder 13, the state where a portion of the paper sheet W on the trailing edge side is still adhered to the blanket impression cylinder 2 after passing through the contact position of the blanket impression cylinder 2 and the transfer cylinder 13 occurs due to an adhesive force of the blanket impression cylinder 2. Accordingly, the check is performed in a state where the tension on the paper sheet W is unstable and an accurate check cannot be thereby performed. However, this is avoided in the embodiment.

As described above, in the embodiment, since the perfector can check both surfaces of the sheet immediately after the printing on both surfaces, it is possible to stop the perfector immediately after generation of a defective paper sheet and thereby avoid an increase of waste paper sheets which would otherwise occur if the operation of the perfector is wastefully continued. Moreover, since the check can be performed by, for example, utilizing the existing cylinder arrangement of the transfer cylinder 13, the delivery cylinder 17*a*, and the like, not only an increase in the size of the perfector can be avoided but also the cost can be reduced due to reduction in the number of parts.

As a matter of course, in the embodiment, since the quality check of both surfaces can be performed in-line in a period between the printing on both surfaces and the delivery, there are no increase in installation space and no increase in the overall length of the perfector.

Moreover, in a so-called satellite-type cylinder arrangement in which many plate cylinders 4 and 5 are arranged around the blanket impression cylinder 2 and the blanket cylinder 3 as in the embodiment, portions from which the circumferential surfaces of the blanket impression cylinder 2 and the blanket cylinder 3 are accessible are limited. However, a portion (space) from which the circumferential surface of the blanket impression cylinder 2 is accessible is formed between: the contact position (see the printing position P1) between the blanket impression cylinder 2 and the blanket cylinder 3 where the printing is performed on the paper sheet W; and the contact position (see the sheet receiving position P2) between the blanket impression cylinder 2 and the transfer cylinder 13.

Accordingly, in the embodiment, the first blanket washing device (washing device) 29 is disposed by utilizing the space described above and this is highly advantageous in terms of design. In other words, the first blanket washing device (washing device) 29 can be disposed at this position because the checking position of the second checking camera 27 is set at a position on the delivery cylinder 17*a*.

Moreover, in the embodiment, since the transporting means such as the transfer cylinder 13 and the delivery cylinder 17*a* are disposed below the blanket impression cylinder 2 on the delivery unit 16 side, the workspace S is formed below the blanket cylinder 3.

Accordingly, the operator can promptly and smoothly perform maintenance and management of the various equipments such as the first blanket washing device 29, the second blanket washing device 30, the second checking camera 27, and the pair of illuminators 28 and check the operating conditions and the like by entering and exiting the workspace S through the opening 40 provided in the main unit frame 35.

In this case, when the door 41 is opened while the perfector is operating or when the door 41 is opened and the operator enters the space S from the opening 40, the main unit motor 44 is stopped and not driven with the door 41 being open. Accordingly, the perfector is safe.

Note that the present invention is not limited to the embodiment described above and various changes such as changes in the cylinder arrangement, ink colors, and the like can be made within the spirit of the present invention, as a matter of course.

INDUSTRIAL APPLICABILITY

The checking device of a perfector according to the present invention is effective in a securities printing press and the like in which quality control is important.

REFERENCE SIGNS LIST

1 printing unit
2 blanket impression cylinder (first printing cylinder)
3 blanket cylinder (second printing cylinder)
4 plate cylinder
5 plate cylinder
6 inking unit
7 inking unit
8 register
9 to 12 transfer cylinder
13 transfer cylinder (transporting means)
14 feeder board
15 feeding unit (supplying unit)
16 delivery unit (discharging unit)
17 delivery chain (transporting means)

17*a*, 17*b* delivery cylinder (transporting means)
21 delivery pile
25 first checking camera
26 pair of illuminators
27 second checking camera (checking device)
28 pair of illuminators
29 first blanket washing device (first washing device)
30 second blanket washing device (second washing device)
35 main unit frame
40 opening
41 door
42 controlling device
43 detecting device
44 main unit motor (drive device of perfector)
S workspace
W paper sheet (sheet)

The invention claimed is:

1. A perfector, comprising:

a printing unit configured to perform printing simultaneously on both surfaces of a sheet;

detecting means for detecting printing conditions on both surfaces of the sheet on which the printing is performed simultaneously; and transporting means for holding and transporting the detected sheet to a discharging unit, wherein the printing unit includes:

a first printing cylinder configured to hold and transport the sheet; and a second printing cylinder disposed lateral to the first printing cylinder and being in contact with the first printing cylinder, the transporting means includes:

a transfer cylinder being in contact with the first printing cylinder and configured to receive, from the first printing cylinder, the sheet on which printing is performed on both surfaces by the first printing cylinder and the second printing cylinder; and a delivery cylinder in contact with the transfer cylinder and configured to receive the sheet from the transfer cylinder, the detecting means includes:

a first checking camera configured to detect the printing condition on one surface of the sheet on the transfer cylinder; and a second checking camera configured to detect the printing condition on the other surface of the sheet on the delivery cylinder, the first checking camera is disposed to be capable of checking the sheet at a position away from a contact position between the first printing cylinder and the transfer cylinder by a distance equal to or more than a length of a maximum-size sheet from a leading end to a trailing end thereof, and wherein the transfer cylinder is a double-size cylinder.

2. The perfector according to claim 1, wherein the first checking camera is disposed on the discharging unit side of the transfer cylinder.

3. The perfector according to claim 2, wherein the perfector comprises:

a first washing device configured to wash a circumferential surface of the first printing cylinder; and a second washing device configured to wash a circumferential surface of the second printing cylinder, the first washing device is disposed to wash the circumferential surface of the first printing cylinder at a position downstream of a contact position between the first printing cylinder and the second printing cylinder in the rotating direction of the first printing cylinder and upstream of the contact position between the first printing cylinder and the transfer cylinder in the rotating direction of the first printing cylinder, and the second washing device is disposed to wash the circumferential surface of the second printing cylinder at a position below the second printing cylinder.

4. The perfector according to claim 1, wherein the first printing cylinder is disposed on the discharging unit side of the second printing cylinder, and the perfector comprises:

a workspace formed below the second printing cylinder; and an opening configured to allow an operator to enter and exit the workspace.

5. The perfector according to claim 4, wherein the second checking camera is disposed below the second printing cylinder.

6. The perfector according to claim 4, further comprising:

a detecting device configured to detect a state where an entry into a workspace is possible or detect an entry of an operator; and a controlling device configured to control a drive device of the perfector on the basis of a detection signal from the detecting device.

* * * * *